United States Patent [19]

Clarke

[11] 4,147,247

[45] Apr. 3, 1979

[54] APPARATUS FOR FEEDING ROD-LIKE ARTICLES

[75] Inventor: Peter A. Clarke, London, Great Britain

[73] Assignee: Molins Limited, England

[21] Appl. No.: 794,704

[22] Filed: May 9, 1977

[30] Foreign Application Priority Data

May 13, 1976 [GB] United Kingdom ..... 19660/76

[51] Int. Cl.[2] ..... B65G 43/08

[52] U.S. Cl. ..... 198/347; 198/466; 198/502; 198/577; 198/592

[58] Field of Search ..... 198/347, 454, 460, 464, 198/469, 502, 524, 571, 572, 573, 577, 592, 466; 214/17 CA

[56] References Cited

U.S. PATENT DOCUMENTS

| | | | |
|---|---|---|---|
| 2,745,410 | 5/1956 | Molins | 198/469 |
| 3,297,138 | 1/1967 | McCombie | 198/572 |
| 3,460,687 | 8/1969 | Bardenhagen | 214/17 CA |
| 3,561,585 | 2/1971 | McCombie | 198/347 |
| 3,578,146 | 5/1971 | Mehlschau | 214/17 CA |
| 3,596,797 | 8/1971 | Wallenborn | 214/17 CA |
| 3,881,611 | 5/1975 | Milbourn | 214/17 CA |
| 3,885,683 | 5/1975 | Bornfleth et al. | 198/347 |
| 3,921,790 | 11/1975 | Hinchcliffe et al. | 198/347 |
| 4,023,669 | 5/1977 | Clarke | 198/347 |

FOREIGN PATENT DOCUMENTS

| | | | |
|---|---|---|---|
| 1261445 | 2/1968 | Fed. Rep. of Germany | 198/592 |
| 2238062 | 2/1973 | Fed. Rep. of Germany | 198/425 |
| 2353806 | 5/1974 | Fed. Rep. of Germany | 198/347 |
| 1966899 | 4/1975 | Fed. Rep. of Germany | 198/347 |
| 2500526 | 9/1975 | Fed. Rep. of Germany | 198/347 |
| 1159794 | 7/1969 | United Kingdom | 198/572 |

*Primary Examiner*—Robert B. Reeves
*Assistant Examiner*—Richard K. Thomson
*Attorney, Agent, or Firm*—Craig & Antonelli

[57] ABSTRACT

A stack former for rod-like articles includes a variable capacity transfer region between a supply conveyor and a stack conveyor. The supply conveyor is mounted on a unit which is pivotable to alter the capacity of the transfer region and which also carries a level sensor. The speed of the stack conveyor and the pivoting drive for the unit are selectively controlled by this sensor. The speed of the stack conveyor is also dependent on the angular displacement of the unit.

18 Claims, 3 Drawing Figures

Figure 1:
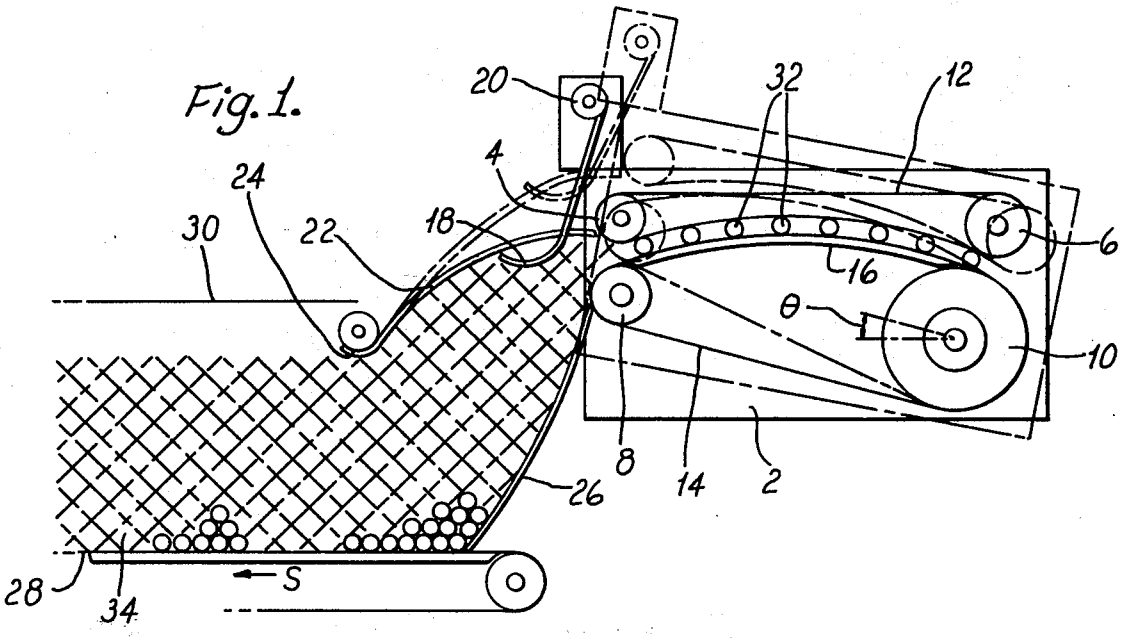

RS
2
18
R1
M1
SW
M2
28

118
122
122A
126
129
128

APPARATUS FOR FEEDING ROD-LIKE ARTICLES

This invention relates to apparatus for feeding rod-like articles, and is particularly concerned with apparatus capable of transforming a line of transverse-moving rod-like articles, such as cigarettes, into a transverse-moving stream having a depth of several articles.

The invention provides apparatus for feeding rod-like articles, comprising first conveyor means for feeding a first stream of rod-like articles in a direction transverse to their lengths towards a transfer region; second conveyor means for moving articles away from the transfer region as a second stream of articles moving transverse to their lengths, the first conveyor means being mounted so that it is displaceable relative to the second conveyor means to vary the capacity of the transfer region; a sensor for monitoring the rod-like articles in the transfer region; and means responsive to signals derived from the sensor for varying the speed of the second conveyor means.

Preferably the apparatus includes means for sensing the position of the first conveyor means and means responsive to signals derived from said sensing means for varying the speed of the second conveyor means, so that the speed of the second conveyor means may be dependent on both the signal from the sensor and the position of the first conveyor means. The first conveyor means may be displaced relative to the second conveyor means by means responsive to signals derived from the sensor. The apparatus preferably includes means for selectively applying signals derived from the sensor either to vary the speed of the second conveyor means or to displace the first conveyor means. The signals may be selectively applied in accordance with conditions downstream of the transfer region or in accordance with the values of the signals themselves.

The first stream may be a single row of cigarettes, as supplied from a cigarette making machine for example, and the second stream may be a moving stack of cigarettes, as supplied to tray filling apparatus such as that disclosed in U.S. Pat. No. 3,967,740 to Desmond Walter Molins, for example.

In one mode of operation the sensor may normally be connected for proportional control of the speed of the second conveyor means according to the level of articles in the transfer region but when the second conveyor means is stopped by external means (as, for example, when a tray is being changed if the second conveyor means is supplying a tray filler) control switches to displacement of the first conveyor means to increase the capacity of the transfer region, so that the first conveyor means need not be stopped.

In a preferred arrangement of the apparatus the first conveyor means is mounted on a unit which is pivoted about an axis parallel to the rod-like articles conveyed. The sensor may be a pivotable arm mounted on the unit and extending into the transfer region. Alternatively the sensor may be pivoted about an axis fixed relative to the position of the second conveyor means. The transfer region may be bounded along at least one side by interleaved or expanding sections which allow relative movement between the first and second conveyor means while confining the rod-like articles.

Figure 3:
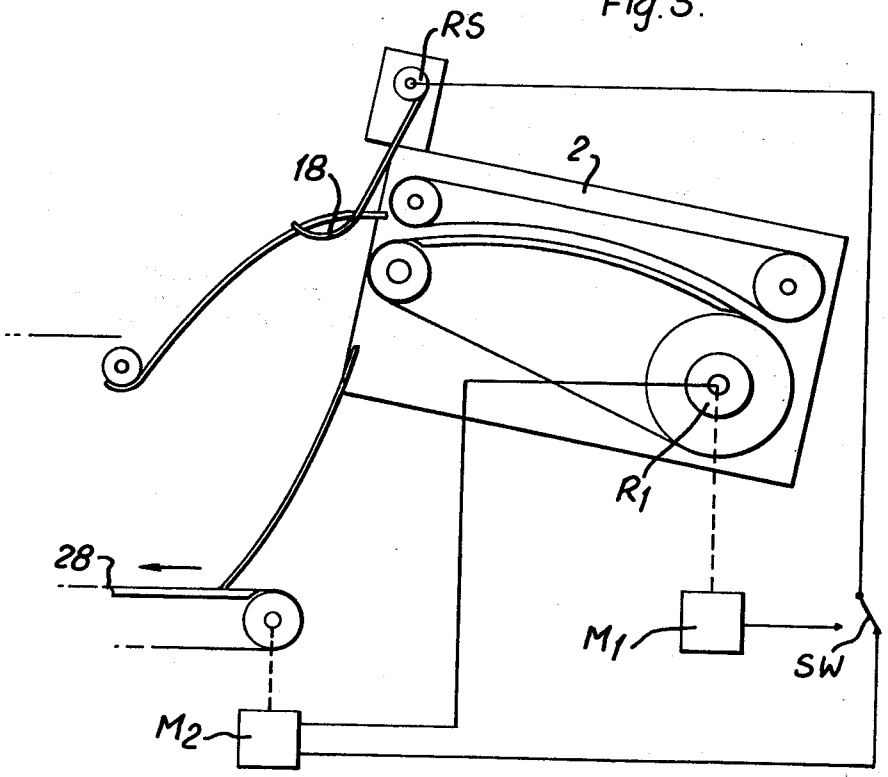
Figure 2:
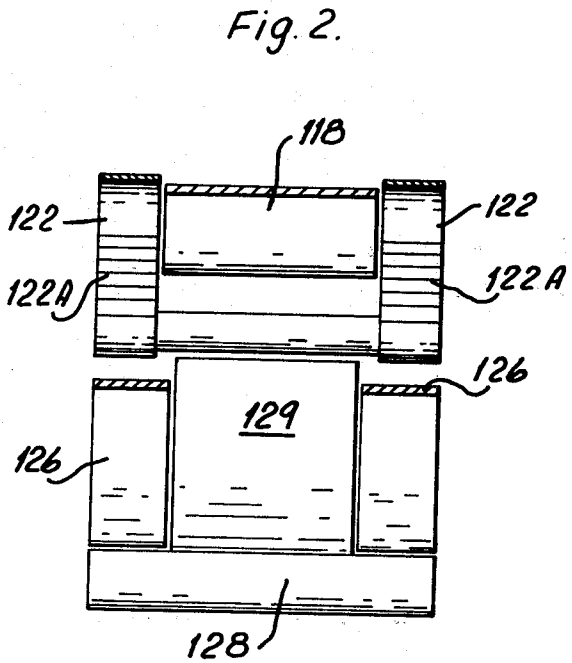

The invention will now be further described, by way of example only, with reference to the accompanying drawings, in which FIG. 1 is a side view of apparatus for feeding cigarettes, FIG. 2 is a transverse sectional view of modified apparatus for feeding cigarettes, and FIG. 3 is a diagram indicating the control of the apparatus of FIG. 1.

The apparatus of FIG. 1 comprises a unit 2 which supports a pair of upper rollers 4, 6 and a pair of lower rollers 8, 10. An upper band 12 passes around the rollers 4, 6 and a lower band 14 passes around the rollers 8, 10 and also around a curved guide surface 16 connected to the unit 2. A movable sensor arm 18 is pivoted to the unit 2 at 20. The whole unit 2 is pivotable about the axis of the roller 10.

An upper curved guide element 22, which comprises interleaved overlapping sections or other expandable material, extends from the region of the roller 4 to a fixed position 24. A lower guide element 26 (which could also be expandable) extends from the region of the roller 8 to the upper surface of a fixed band conveyor 28. An upper surface 30, which could be defined by a further band conveyor, is arranged at a fixed distance above the conveyor 28.

The guide element 22 comprises transversely spaced members, at least in the region of the sensor arm 18, so that the arm 18 can project into the space below the guide element. The distance between the transversely spaced members is less than the length of a cigarette 32 conveyed by the apparatus, so that the guide element 22 can still confine the cigarettes.

As shown in FIG. 2, which is a vertical sectional view through the transfer region of slightly modified apparatus, the conveyor 128 could be provided with upstanding divider plates 129 to separate the cigarettes conveyed into batches. Thus the conveyor could be constructed in the same way as the separator conveyor disclosed in the above mentioned U.S. Pat. No. 3,967,740. In this case the lower guide element 126 comprises laterally spaced elements to allow each divider plate to pass. The laterally spaced elements could be flat rather than curved and could advantageously be inclined at 60° to the conveyor surface. FIG. 2 also shows laterally spaced guide elements 122, having expandable sections 122*a* and a sensor 118 extending between these elements.

For the sake of convenience in the following description of the operation of the illustrated apparatus it is assumed that the apparatus is feeding cigarettes from a cigarette making machine to a tray filling unit. A stream consisting of a line of transversely moving cigarettes 32 is fed from the making machine to the unit 2 and is conveyed between the bands 12, 14. The tension in the curved upper band 12 causes the cigarettes to be firmly gripped between the bands. Cigarettes are fed by the bands 12, 14 into a stack forming or transfer region over the conveyor 28 and subsequently the cigarettes are moved by the conveyor as a stack 34 towards the tray filling unit.

In normal operation, when the cigarette making machine and the tray filler are running, the unit 2 is in its lower-most position as shown in full lines in the drawing and the sensor arm 18 is lying adjacent or against its lower stop (not shown). In this situation there is a small head of cigarettes in the transfer region and the velocity S of the conveyor 28 is So. If an accumulation of cigarettes occurs in the transfer region under the sensor arm 18 so that the arm is lifted from its lower stop the arm sends a signal to the drive for conveyor 28 so that its speed is increased to remove the excess cigarettes. The signal may be derived from the position of the arm 18 by means of a conventional rotary regulator having its axis at 20. In general, when the making machine and tray filler are running normally, $S = So + S(x)$, where S(x) is a function of the displacement (x) of the arm 18 relative to its "normal" position (i.e. at or adjacent its lower stop), and S(x) = 0 when x = 0.

If the tray filler stops accepting cigarettes (e.g. during a tray change) the conveyor 28 is automatically stopped, so that S = 0. In this condition (i.e. when S = 0) the sensor arm signal is switched from control of the conveyor 28 to control of a drive which rotates the unit 2 about the axis of roller 10. Thus, while the conveyor 28 is stopped, further cigarettes 32 delivered between the bands 12, 14 cause an accumulation of cigarettes under the sensor arm 18, which is in turn displaced causing corresponding displacement of the unit 2 by rotation through an angle $\theta$ about the axis of roller 10. Such movement by the unit 2 provides a useful temporary reservoir by increasing the volume of the transfer region over the conveyor 28 which is available for cigarettes. The capacity of this reservoir may be such that it is not necessary to stop the bands 12, 14 during a normal tray change.

In general, if S = 0,$\theta$ = F (x) and $\theta$ = 0 when X = 0. It should be realized that since the displacement x is interversely related to $\theta$ (i.e. as $\theta$ increases x tends to decrease because of the mounting of arm 18 on unit 2) it is possible to arrange for x to be maintained approximately constant as $\theta$ varies. If x increases so that $\theta$ reaches its maximum permissible value (i.e. the unit 2 reaches its upper stop) the cigarette making machine is stopped.

When the tray filler is restarted, the conveyor 28 is automatically restarted and the signal from the sensor arm 18 is switched so that it once again controls the velocity S of conveyor 28. However, the full equation for the velocity of conveyor 28 is: $S = So + S(x) + S'(\theta)$, where $S'(\theta)$ is a function which increases with $\theta$ and $S'(0) = 0$. The signal dependent on $\theta$ may be derived by means of a rotary regulator associated with the mounting of unit 2 about the axis of roller 10, in substantially the same way as disclosed in the above-mentioned U.S. Pat. No. 3,625,340. Hence, the accumulation of cigarettes remaining under the sensor arm 18 after the tray filler is restarted is quickly reduced by the increased conveyor speed. As the sensor arm 28 falls the value of $\theta$ correspondingly falls until the position is soon reached with both $\theta$ and x at zero.

Instead of immediate switching of the signal derived from the sensor arm 18 when the conveyor 28 is stopped, the arm could have a normal range in which it controls the conveyor 28 and an upper range used only when there is severe accumulation of cigarettes, as would be caused when the conveyor 28 stops, this upper range controlling the drive for pivotal rotation of the unit 2. In this case, the equation for the volocity S preferably becomes $S = So + S(x) + S'(\theta)$, $S'(\theta) = F'(x)$ with $F'(x) = 0$ for $X < Xo$, where Xo is the value of the displacement of the sensor at the junction of the normal and upper ranges.

Velocity So may be zero so that, when $\theta$ is zero, the velocity S of conveyor 28 may be under proportional control according to the displacement of the sensor 18. Increase of displacement of the unit 2, i.e. increase of 74, 0 may also proportionately control the velocity S. FIG. 3 shows diagrammatically a circuit for operating the apparatus of FIG. 1. The sensor 18 operates a rotary regulator RS connected to a switch SW, having a first contact connected to a motor M1 for pivotally displacing the unit 2 and a second contact connected to a motor M2 for driving the conveyor 28. The switch SW is actuated according to whether the tray fillter is or is not accepting cigarettes. A further rotary regulator R1 attached to the unit 2 adjacent its axis of pivoting is connected to the motor M2 for the conveyor 28.

I claim:

1. Apparatus for feeding rod-like articles, comprising first conveyor means for feeding a first stream of rod-like articles in a direction transverse to their lengths; a transfer region towards which said first stream is fed by said first conveyor means; second conveyor means for moving articles away from the transfer region as a second stream of articles moving transverse to their lengths; a sensor for monitoring the rod-like articles in the transfer region; and means responsive to signals derived from the sensor for varying the speed of the second conveyor means; means supporting the first conveyor means so that it is displaceable relative to the second conveyor means to vary the capacity of the transfer region; and means for varying the speed of the second conveyor means in accordance with the displacement of the first conveyor means relative to the second conveyor means.

2. Apparatus as claimed in claim 1 including means responsive to signals derived from the sensor for displacing the first conveyor means relative to the second conveyor means.

3. Apparatus as claimed in claim 1 wherein the first conveyor means is displaceable by pivoting about a fixed axis which is parallel to the rod-like articles in the first and second streams.

4. Apparatus as claimed in claim 3 wherein the first conveyor means includes upper and lower bands adapted to convey a stream comprising a single row of rod-like articles.

5. Apparatus as claimed in claim 3 wherein the second conveyor means is adapted to convey a stream comprising a stack of rod-like articles away from the transfer region.

6. Apparatus as claimed in claim 3 wherein the first conveyor means is arranged at a level generally above that of the second conveyor means.

7. Apparatus as claimed in claim 6 including guide elements extending generally between said first and second conveyor means and defining the transfer region.

8. Apparatus as claimed in claim 7 wherein at least one of said guide elements is adapted to be of variable length.

9. Apparatus as claimed in claim 7, wherein said sensor includes a movable arm, including laterally spaced guide elements which allow the arm to pass between them.

10. Apparatus as claimed in claim 5, wherein the second conveyor means includes spaced divider plates for separating the second stream into batches, including laterally spaced guide elements defining part of the boundary of the transfer region and between which elements said divider plates can pass.

11. Apparatus as claimed in claim 2 including means for switching signals derived from the sensor either to vary the speed of the second conveyor means or to displace the first conveyor means.

12. Apparatus as claimed in claim 3 wherein the means for varying the speed of the second conveyor means in accordance with the displacement of the first conveyor means comprises means for sensing angular displacement of the first conveyor means relative to said axis.

13. Apparatus for feeding rod-like articles, comprising first conveyor means for feeding a first stream of rod-like articles in a direction transverse to their lengths; a transfer region towards which the first stream is fed by said first conveyor means; second conveyor means for moving articles away from the transfer region as a second stream of articles moving transverse to their lengths; means for varying the speed of the second conveyor means; means for supporting the first conveyor means so that it is displaceable relative to the second conveyor means; means for displacing the first conveyor means relative to the second conveyor means; a sensor for monitoring the rod-like articles in the transfer region; and means for switching signals derived from the sensor either to vary the speed of the second conveyor means or to displace the first conveyor means.

14. Apparatus as claimed in claim 13 wherein said signals are switched according to conditions downstream of the transfer region.

15. Apparatus as claimed in claim 13 wherein said signals are switched according to whether said signals fall in a first range or a second range of possible values.

16. Apparatus as claimed in claim 15 wherein the sensor includes a movable element which responds to the general quantity of rod-like articles in the transfer region and is movable over a first range in which signals are applied to vary the speed of the second conveyor means and over a second range in which signals are applied to displace the first conveyor means to vary the capacity of the transfer region.

17. Apparatus as claimed in claim 13 wherein the sensor comprises a level detector for rod-like articles in the transfer region.

18. Apparatus as claimed in claim 17 wherein the sensor and first conveyor means are mounted on a common support.

* * * * *